United States Patent [19]

Koyama

[11] Patent Number: 4,953,744

[45] Date of Patent: Sep. 4, 1990

[54] MOBILE REFUSE CONTAINER

[76] Inventor: Kunio Koyama, 22798 W. Lochnora, Hawthorn Woods, Ill. 60047

[21] Appl. No.: 334,475

[22] Filed: Apr. 7, 1989

[51] Int. Cl.[5] ..... B65D 25/16; B65D 83/00

[52] U.S. Cl. ..... 220/404; 220/908; 221/281; 232/43.2; 232/43.3; 280/47.17

[58] Field of Search ..... 220/1 T, 263, 404; 221/281; 414/278, 287, 288, 328, 403, 404; 232/43.1, 43.2, 43.3

[56] References Cited

U.S. PATENT DOCUMENTS

| | | | |
|---|---|---|---|
| 1,093,033 | 4/1914 | Canby | 220/23.4 |
| 1,658,880 | 2/1928 | Brunetti | 232/43.1 |
| 1,896,430 | 2/1933 | Stanawitz | 221/281 |
| 2,644,737 | 7/1953 | Davis | 220/263 |
| 3,211,367 | 10/1965 | Jessop | 232/43.2 |

FOREIGN PATENT DOCUMENTS

| | | | |
|---|---|---|---|
| 2412477 | 8/1979 | France | 220/1 T |
| 2580604 | 10/1986 | France | 220/1 T |
| 2601052 | 1/1988 | France | 220/1 T |
| 1555543 | 11/1979 | United Kingdom | 220/1 T |

*Primary Examiner*—Jimmy G. Foster

[57] ABSTRACT

A mobile refuse container that uses plastic liner bags, with a bottom ramp and door arrangement that ejects filled bags from the front of the container.

10 Claims, 2 Drawing Sheets

MOBILE REFUSE CONTAINER

BACKGROUND OF THE INVENTION

Flexible plastic trash, leaf and garbage bags have had a dramatic rise in popularity over the last 10 or 15 years, and these containers are typically 25 to 40 gallon capacity bags having thicknesses on the order of 0.015 to 0.035 inches. Because of the thin wall thickness of these containers, they are very flexible and cannot be held in an upright position without some support and, therefore, semi-rigid container racks have been developed over the past years for supporting these plastic bags in an open position where they can be more easily filled with refuse, leaves or excess gardening products.

In many of these containers the bags are placed one at a time within the container with the upper end of the bag folded over the top edge of the semi-rigid container to hold the bag open. After the bag is filled, it is removed from the container and a tie member is wrapped around the top of the bag after being cinched closed by the user. The bag is then picked up manually by the user and transported to another location for subsequent removal.

The process of lifting the filled bag from the container is a difficult one for many people in part because the container itself acts as a seal for the filled bags and creates a vacuum underneath that inhibits movement of the bag upwardly in the container.

Furthermore, carrying the bag by itself is difficult for many people.

Several prior patents show mobile two-wheeled refuse containers for flexible plastic bags including the Brighton, U.S. Pat. No. 3,241,750, that shows a front opening door opposite a handle assembly and a top opening hinge cover and clamps and loops for holding flexible plastic bags at the top of the container on all sides. While undoubtedly the Brighton container permits the transport of a filled bag within the container from one location to another, and thus eliminates one prior difficulty the user has carrying the filled container from one location to another. However, Brighton discusses nothing whatsoever about the purpose of the front door and, therefore, one must assume that Brighton intends the bag to be removed from the top as opposed to the front door since all prior art containers for flexible bagging operate in this manner.

Several patents, such as the Getz, U.S. Pat. No. 3,964,630, show fastening frames for holding the top of the flexible bag in a refuse container, and a plurality of other patents, such as the Jackson, et at., U.S. Pat. No. 4,519,502; the Taylor, U.S. Pat. No. 2,796,309, and the Rich, U.S. Pat. No. 4,179,132, show separate containers auxiliary to a main refuse container for holding additional plastic bags.

There is also an additional patent, the Bates, U.S. Pat. No. 1,970,727, that shows a leaf incinerator and dump cart where the leaf ashes fall beneath a horizontal grate to a bottom wall having an inclination of about 20 to 25 degrees. A door is provided through which ashes may be removed. The Bates device, however, is not designed to hold flexible plastic bags nor is the bottom wall or the door designed to discharge such a bag. More fundamentally, however, is the fact that the Bates bottom wall is not inclined sufficiently so the entire contents would be dishcarged upon door opening.

It is a primary object of the present invention to ameliorate the problems noted above in mobile refuse containers.

SUMMARY OF THE PRESENT INVENTION

In accordance with the present invention, a mobile refuse container is provided that securely holds plastic liner bags in position during loading, and it has a bottom ramp and door arrangement that ejects filled bags from the front of the container without lifting the bag from the container or dragging it through the door.

Toward these ends, the present container has a removable clamping top frame that holds the top of the bag open against the walls of the container, a pair of wheels and a handle for permitting easy wheeled transport of the container from one location to another, a pair of doors on the front of the container that hold the bag in position in the container and a steeply inclined ramp forming the bottom wall of the container that causes filled bags, after cinching, to self-eject from the container when the forward doors are opened at the desired discharge location, such as along the curb where refuse services pick up.

Other objects and advantages of the present invention will appear from the following detailed description.

DETAILED DESCRIPTION OF THE PREFERRED EMBODIMENT

Figure 1:
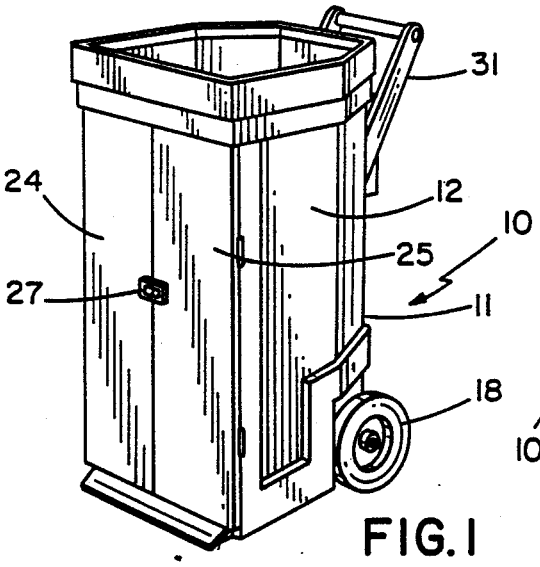
FIG. 1 is a perspective view of a mobile refuse container according to the present invention.

Referring to the drawings and particularly FIGS. 1 to 6, a mobile refuse container 10 is illustrated according to the present invention consisting of a one-piece injection molded plastic container 11 having a right side wall 12, a left side wall 13, a rear wall 14, and an inclined bottom wall 16 having a angle of approximately 35 degrees to horizontal. A pair of wheel assemblies 18 are mounted on an axle 20 extending through and supported in side wall stepped portions 21, as seen more clearly in FIG. 7. The recessed stepped portions 21 permit the outside of the wheel assemblies to be substantially flush with side walls 12 and 13 providing a more streamlined and compact construction.

A pair of doors 24 and 25 are hinged to the side walls 12 and 13 and close the open forward side of the container 11, and they have a suitable latch mechanism 27 for maintaining them in a closed position illustrated in FIGS. 1, 3, 4, 6, and 7.

A handle assembly 31 is provided on the rear wall 14 to facilitate tipping the container 10 rearwardly and rolling it to a different location in a quite easy manner.

Figure 2:
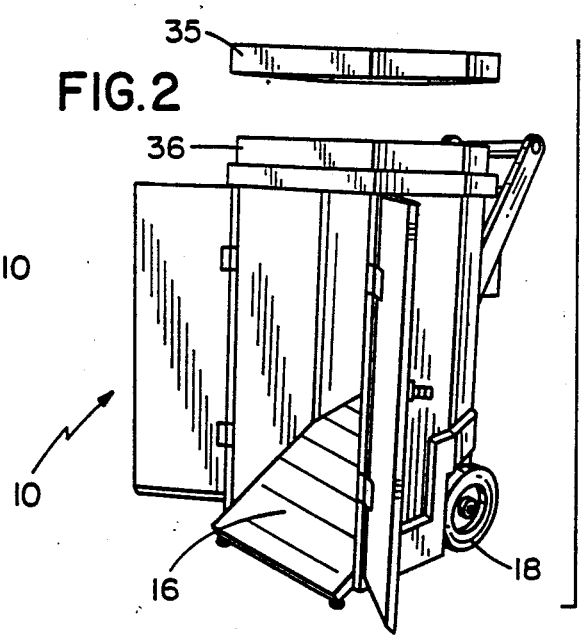
FIG. 2 is a perspective view of the mobile refuse container illustrated in FIG. 1 with the top frame exploded and its front doors open.
Figure 3:
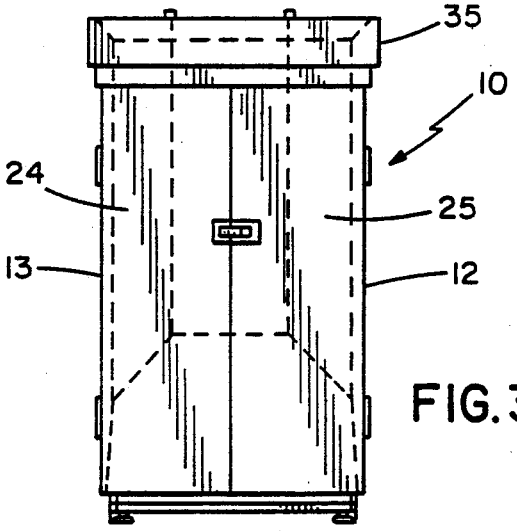
FIG. 3 is a front view of the mobile refuse container illustrated in FIGS. 1 and 2.
Figure 4:
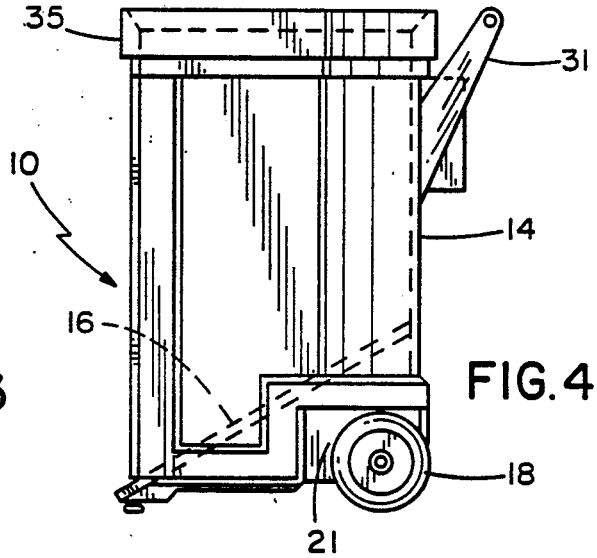
FIG. 4 is a right-side view of the mobile refuse container according to the present invention.
Figure 5:
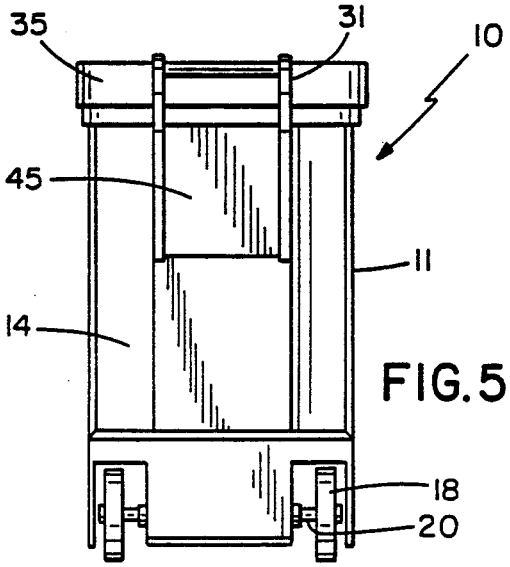
FIG. 5 is a rear view of the mobile refuse container according to the present invention.
Figure 6:
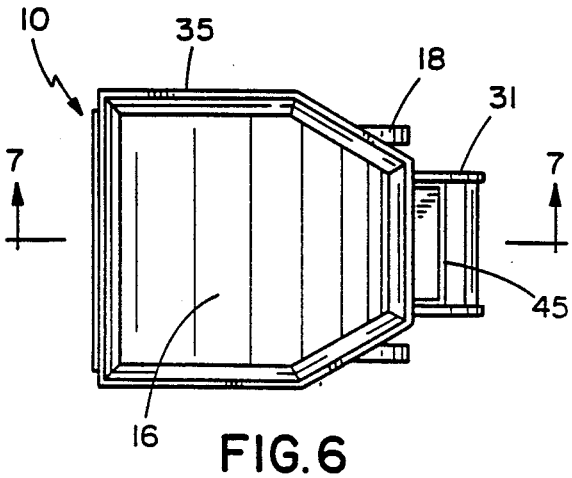
FIG. 6 is a top view of the mobile refuse container according to the present invention.
Figure 7:
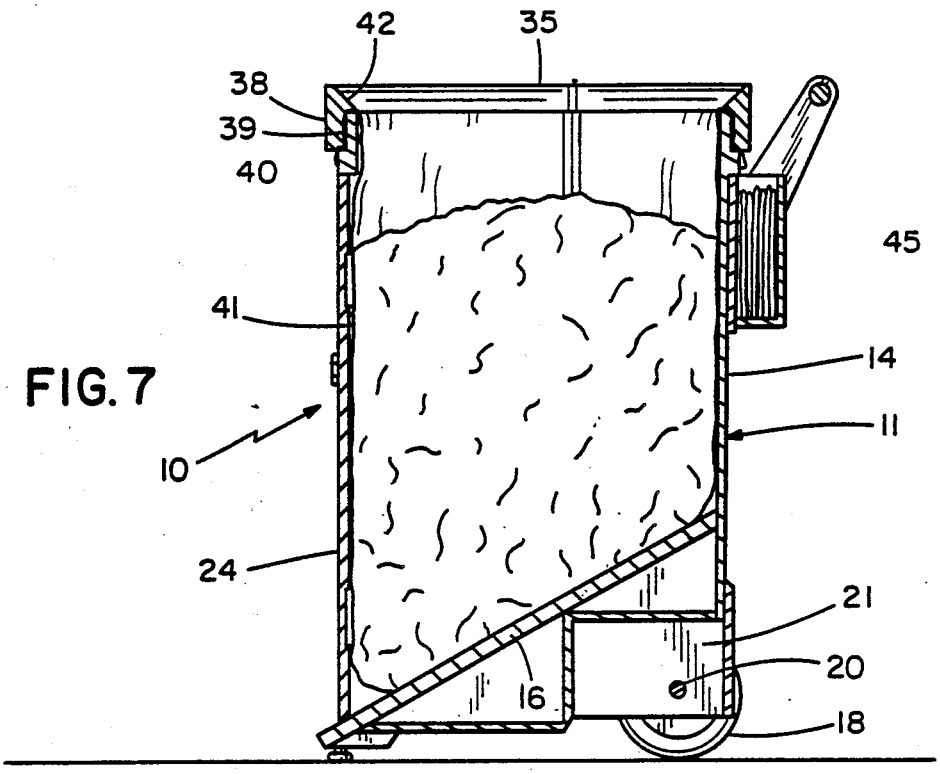
FIG. 7 is an enlarged longitudinal section of the present mobile refuse container taken generally along line 7—7 of FIG. 6.
Figure 8:
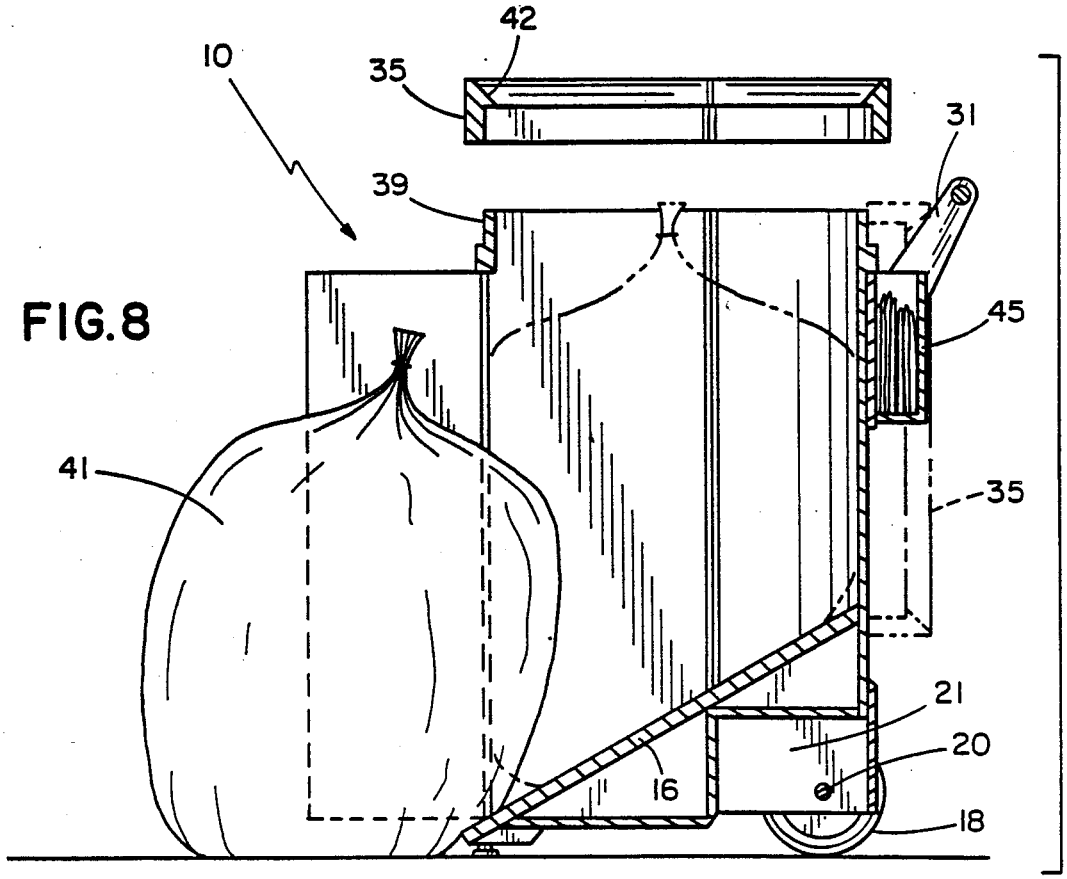
FIG. 8 is a longitudinal section of the present mobile refuse container similar to FIG. 7 with the top frame removed and the front doors open during bag discharge.

A generally rectangular one-piece injection molded frame member 35 is provided that is selectively removable from a stepped flange 36 on the top of container 11 as seen clearly in FIGS. 2, 7, and 8. Frame 35 has a downwardly extending flange 38 that fits over recess stepped portion 39 of flange 36 to hold upper portion 40 of flexible plastic bag 41 open at the top of the container 11. The frame 35 has a peripheral tapered wall 42 at the top thereof that facilitates the deflection of refuse into bag 41, as seen clearly in FIG. 7.

Rear wall 14 also supports an auxiliary small container 45 where additional bags 41 may be stored prior to use.

In use, the liner bag 41 is placed inside the container 11 and folded over the upper reaches of upper container portion 39 and then locked in this open position by placing frame member 35 over the flange 36 in the position illustrated in FIG. 7.

After the container 41 is filled, the frame 35 is removed and placed in its dotted line position over handle assembly 31 illustrated in FIG. 8. The bag 41 is then cinched and tied and the entire container 11 is moved to a discharge location, such as along the curb, where doors 24 and 25 are opened. An important aspect of the present invention is that the bottom wall or ramp 16, as seen clearly in FIGS. 7 and 8, has a sufficient inclination so that it automatically causes the filled container 41 to slide down the ramp when doors 24 and 25 are opened, completely ejecting it from container 10.

The container 10 is then moved slightly rearwardly from the ejected bag so the doors 24 and 25 can be closed, and the container 10 is wheeled back to the work location for the bag replacement from auxiliary container 45.

I claim:

1. A mobile refuse container, comprising: a container having an open top forming a loading opening for refuse and flexible plastic bags, said container having an open side forming a discharge opening for the flexible plastic bag when full, said open side having sufficient height to discharge a full plastic bag, releasable means on the container for selectively holding the bag in the container near its top in an open condition, and means for automatically ejecting the bag from the container when the releasable means is activated, said means for automatically ejecting the bag from the container including a steeply inclined ramp in the bottom of the container on which the bag rests, said ramp having an uninterrupted upper surface constructed to support the flexible plastic bag.

2. A mobile refuse container as defined in claim 1, wherein the ramp is angled approximately 40 degrees to a horizontal plane.

3. A mobile refuse container as defined in claim 1, wherein the means for selectively holding the bag includes a pivotal member over the open side.

4. A mobile refuse container as defined in claim 3, wherein the pivotal member is a door.

5. A mobile refuse container, comprising: a container having an open top forming a loading opening for refuse and flexible plastic bags, said container having an open side forming a discharge opening for the flexible plastic bag when full, releasable means on the container for selectively holding the bag in the container, means for automatically ejecting the bag from the container when the releasable means is activated, and including a pair of wheels mounted on the lower end of the container.

6. A mobile refuse container as defined in claim 5, including a handle on the container to assist in transporting the container.

7. A mobile refuse container, comprising: a container having an open top forming a loading opening for refuse and flexible plastic bags, said container having an open side forming a discharge opening for the flexible plastic bag when full, releasable means on the container for selectively holding the bag in the container, means for automatically ejecting the bag from the container when the releasable means is activated, and including a bag supply container on one side of the container.

8. a mobile refuse container, comprising: a container having a bottom and at least one side wall with an upper opening forming a loading opening for bags and refuse, means to support a flexible plastic bag in an open position near its top, a side opening on the container forming a discharge opening, said open side having sufficient height to discharge a full plastic bag, a selectively opening member over the side opening to prevent discharge of the bag, and a ramp in the bottom of the container upon which the bag rests, said ramp having a sufficient inclination so that when the opening member is opened, the bag will discharge automatically from the container, said ramp having an uninterrupted upper surface to support the bottom of the flexible plastic bag.

9. A mobile refuse container, comprising: a container having a bottom and at least one side wall with an upper opening forming a loading opening for bags and refuse, a side opening on the container forming a discharge opening, a selectively opening member over the side opening to prevent discharge of the bag, a ramp in the bottom of the container upon which the bag rests, said ramp having a sufficient inclination so that when the opening member is opened, the bag will discharge automatically from the container, said ramp being angled approximately 40 degrees to a horizontal plane, the pivotal member being a door, a pair of wheels mounted on the lower end of the container, and a handle on the container to assist in transporting the container.

10. A mobile refuse container, comprising: a container having a bottom and at least one side wall with an upper opening forming a loading opening for bags and refuse, a side opening on the container forming a discharge opening, a selectively opening member over the side opening to prevent discharge of the bag, a ramp in the bottom of the container upon which the bag rests, said ramp having a sufficient inclination so that when the opening member is opened, the bag will discharge automatically from the container, the ramp being angled approximately 40 degrees to a horizontal plane, the pivotal member is a door, a pair of wheels mounted on the lower end of the container, a handle on the container to assist in transporting the container, and a bag supply container on one side of the container.

* * * * *